United States Patent [19]

Samuelson

[11] 4,445,969

[45] May 1, 1984

[54] PROCESS FOR THE DELIGNIFYING BLEACHING OF CELLULOSE PULP BY ACTIVATING THE PULP WITH $NO_2$ AND OXYGEN

[75] Inventor: Hans O. Samuelson, Gothenburg, Sweden

[73] Assignee: Mo och Domsjo Aktiebolag, Ornskoldsvik, Sweden

[21] Appl. No.: 449,889

[22] Filed: Dec. 16, 1982

[30] Foreign Application Priority Data

Dec. 30, 1981 [SE] Sweden ..... 8107858

[51] Int. Cl.[3] ..... D21C 1/04; D21C 3/16; D21C 9/10

[52] U.S. Cl. ..... 162/40; 162/65; 162/81

[58] Field of Search ..... 162/90, 65, 81, 19, 162/40, 60

[56] References Cited

U.S. PATENT DOCUMENTS 2,110,546 3/1938 Dreyfus ..... 162/81
2,733,992 2/1956 Reyerson ..... 162/63
4,076,579 2/1978 Brink ..... 162/63
4,406,735 9/1983 Samuelson ..... 162/40

OTHER PUBLICATIONS

Clarke, "Paper Trade Journal", *Tappi*, Sect. 118 62; 1944.

*Primary Examiner*—Steve Alvo

[57] ABSTRACT

A process for delignifying bleaching cellulose pulp in three stages, an activating stage, and first and second alkaline stages, NO and/or $NO_2$ and $O_2$, and optionally $HNO_3$, being supplied to the water-containing pulp in the activating stage; in the first alkaline stage, alkali being supplied as carbonate, primarily $HCO_3^-$, with oxygen gas having a partial pressure, on average, of from 0 to 0.2 MPa, the lignin content of the pulp being lowered in this stage so that the Kappa number of the pulp after the stage is from 10 to 60% of the Kappa number of the pulp entering the activating stage; in the second alkaline stage, alkali being supplied as carbonate, primarily $CO_3^=$, with oxygen gas at a partial pressure, on average, of from 0.1 to 3 MPa.

20 Claims, 1 Drawing Figure

Figure 1:
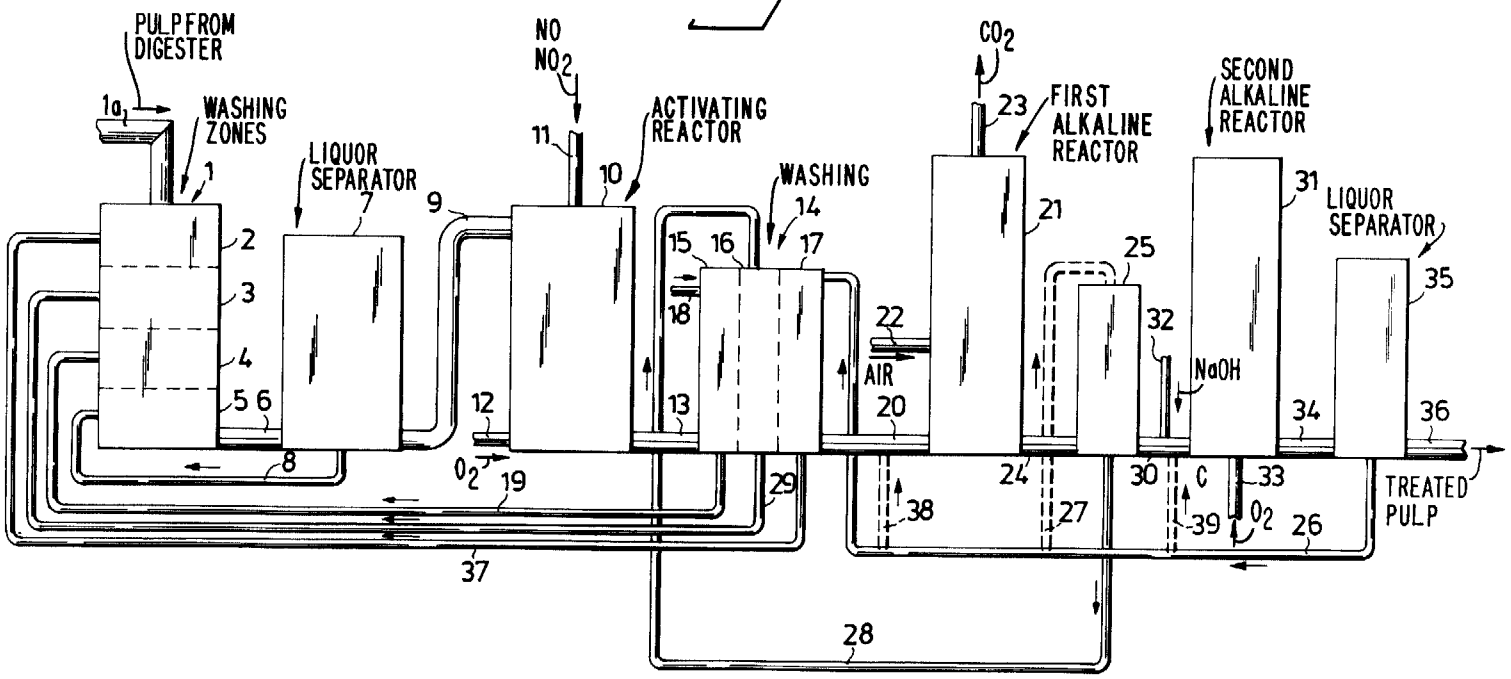

PROCESS FOR THE DELIGNIFYING BLEACHING OF CELLULOSE PULP BY ACTIVATING THE PULP WITH $NO_2$ AND OXYGEN

It is well known that chlorine-containing bleaching agents give rise to chlorinated aromatic substances. The major part can not be destroyed by biological purification of the sewage water. Some chlorinated compounds discharged with spent bleach liquor are bioaccumulatable and taken up by fish. Some chlorinated products have been found to be mutagens.

Consequently, disposal of chlorine-containing waste bleaching liquor from bleaching plants constitutes a very serious problem. Efforts have been made to reduce the use of free or elementary chlorine in the bleaching of cellulose pulp by use of chlorine dioxide instead. The production of chlorine dioxide requires about three times as much electrical energy per kilogram of active chlorine as elementary chlorine.

Nitrogen dioxide has been proposed as a substitute for chlorine in the bleaching delignification of cellulose pulp, and has been studied by Clarke (*Paper Trade Journal, Tappi. Sect.* 118 62 (1944)). Clarke has found that cellulose pulp can be partially delignified by treating the pulp in an aqueous suspension for from 1 to 1.5 hours at 90° C. with nitrogen dioxide, followed by extraction at 90° C. for 30 minutes, or at 50° C. for 60 minutes at a 7% pulp consistency and an alkali charge corresponding to 2% NaOH, calculated on the dry weight of the pulp. The treatment results in a severe depolymerization of the cellulose, which is reflected in a very low viscosity of the treated pulp, compared with pulp subjected to chlorination and alkali extraction.

Bourit (French patent specification No. 2,158,873) avoids depolymerization by applying a delignification process in which the pulp is treated with nitrogen dioxide at low temperature, preferably a temperature below 20° C., and for a long period of time, followed by an alkali extraction under mild conditions. The cellulose pulp is only delignified to a very small extent, however, and the method does not afford any solution to existing environmental problems.

The delignification of lignocellulosic material by treatment with nitrogen dioxide, followed by washing with water, treatment with alkali, and subsequent treatment with oxygen gas, has also been proposed in Swedish patent application No. 77 05136-5. However, this technique has not been put into commercial practice, because although enabling a high degree of delignification, the method causes a drastic lowering of the viscosity.

Another proposal which has not come into practice has been made in Swedish patent application No. 75 06646-4. This bleaching process includes the steps of (1) treating the cellulosic material with a blend of nitrogen monoxide and nitrogen dioxide with nitrogen monoxide in a molar excess, (2) washing with water, and (3) then treating with alkali, for example, in the presence of oxygen gas, under superatmospheric pressure. The nitrogen dioxide can optionally be generated in situ from nitrogen monoxide and oxygen, in which case the nitrogen monoxide is added in an excess of four times the added molar amount of oxygen. The reaction proceeds under superatmospheric pressure with respect to nitrogen monoxide; for example, 7 $kp/cm^2$ is shown in Example 1. The nitrogen oxides are removed by depressurizing, followed by evacuation. In every Example, a superatmospheric pressure is employed in the handling of the nitrogen oxides. The handling problems remain, with a great risk of injury to both the internal and external surroundings, and a high consumption of nitrogen oxides. This method also results in a considerable lowering of the viscosity, although it does enable a high degree of delignification to be obtained.

When the pretreatment with nitrogen oxide is followed by an oxygen gas bleaching stage, it is said to be suitable, subsequent to displacing or washing from the pulp pulping liquor derived from a pulping process with the use of waste liquor derived from the oxygen gas bleaching, to wash the pulp with the acid washing liquid obtained in the washing stage after the pretreatment. When the acid washing liquid is not washed from the pulp before treating the pulp with nitrogen dioxide, the pH of the liquid is reported to be 2.0, which corresponds to about 0.01 gmole nitric acid, calculated per kg of water in the pulp. The prime object of the method is to remove harmful metal compounds from the pulp.

In summary, the pretreatment of cellulose pulp with nitrogen dioxide $NO_2$ before an oxygen gas bleaching makes possible a more complete delignification and an improved oxygen gas bleaching, without deterioration in the paper-making properties of the pulp. However, relatively large quantities of nitrogen oxides and starting material (ammonia) for the manfacture of said oxides, respectively, are consumed in the process.

In accordance with Samuelson, U.S. Ser. No. 270,438, ffiled June 4, 1981, the activation stage is carried out with nitrogen dioxide gas in the presence of oxygen gas in an amount such that nitrogen monoxide formed as an intermediate is consumed, while regulating the amount of oxygen gas that is added in such a manner that at the conclusion of the activation stage practically all of the nitrogen monoxide and nitrogen dioxide have been consumed.

That invention accordingly provides a process for the treatment of cellulose pulp with nitrogen dioxide $NO_2$ adapted for application before an oxygen gas bleaching to make possible a more complete delignification and an improved oxygen gas bleaching, without deterioration in the paper-making properties of the pulp, which comprises subjecting the cellulose pulp to an activation reaction with nitrogen dioxide gas in the presence of water and pure oxygen gas in an amount within the range from about 0.1 to about 5 moles per mole of $NO_2$ and in an amount within the range from about 0.6 to about 5 moles per mole of NO, so that nitrogen monoxide formed in the activation is utilized in the activation reaction.

That invention also provides a process for the delignification of cellulose pulp, including chemical pulp prepared from the digestion of lignocellulosic material, which comprises bringing the cellulose pulp in an activation stage in the presence of water and in contact with a gas phase containing nitrogen dioxide and modifying the lignin of the cellulose pulp by reaction with nitrogen dioxide; adding oxygen gas to the activating reaction in an amount within the range from about 0.1 to about 5 moles per mole of $NO_2$ and in an amount within the range from about 0.5 to about 5 moles per mole of NO, so that nitrogen monoxide formed in the activation is utilized in the activation reaction; and then in a second stage, subjecting the pulp to an oxygen gas bleaching in the presence of an alkaline-reacting neutralization medium or neutralizing agent.

In accordance with Samuelson, U.S. Ser. No. 330,406, filed Dec. 14, 1981, cellulose pulp produced by chemically pulping lignocelulosic material is contacted in an activating stage in the presence of water with a gas phase containing $NO_2$ and oxygen gas, which is supplied in order to utilize the intermediate product NO for activation; and thereafter the pulp is subject to an alkali treatment, both the activating stage and the alkali treatment stage being carried out under drastic conditions, at such high temperature during the activating stage as to obtain a certain degree of degradation of the cellulose molecule, and at a temperature during the alkali treatment process within the range from about 95° to about 150° C., suitably from 101° to 140° C., preferably from 110° to 120° C., the treatment time at 95° C. exceeding 45 minutes, at 101° C. exceeding 30 minutes, and at 110° C. exceeding 15 minutes.

The change in the intrinsic viscosity of the cellulose pulp is used as a measurement of the extent to which the cellulose molecules have been degraded. The viscosity values given therein have all been determined without removing lignin and hemicellulose, which is the most reproducible method for pulps with a moderate lignin content (for example with sulfate pulps having a Kappa number below 35).

This process has however the disadvantage that it requires a very high alkali charge, and results in a high loss of carbohydrates, if the two-stage process is carried far enough to achieve a low lignin content.

In accordance with Samuelson, U.S. Ser. No. 358,998 filed Mar. 17, 1982, residual lignin in cellulose pulp produced by chemically pulping lignocellulosic material is removed while maintaining good pulp quality by contacting the cellulose pulp in an activating stage in the presence of water with a gas phase containing $NO_2$ and oxygen gas at a temperature within the range from about 40° to about 100° C. sufficient to obtain a degradation of the cellulose molecules resulting in a reduction in the intrinsic viscosity of the cellulose pulp during the activation stage within the range from about 2 to about 35% compared to the intrinsic viscosity prior to the activation; and then subjecting the pulp to an oxygen gas-alkali-treatment at a temperature within the range from about 80° to about 150° C., at an oxygen partial pressure within the range from about 0.005 to about 0.18 MPa.

A partial pressure of 018 MPa with respect to oxygen gas during a major part of the oxygen gas-alkali-treatment affords rapid delignification and good selectivity, while delignification at 0.005 MPa takes place very slowly. At a partial pressure below 0.005 MPa, the bleaching is reduced, and the brightness of the pulp is impaired. The pulp acquires a greyish color, but pulp treated at a higher oxygen gas pressure becomes a pure yellow color. In addition, the pulp yield decreases at low oxygen pressure.

In accordance with Samuelson Ser. No. 361,289, filed Mar. 24, 1982, a process is provided for activating chemical cellulose pulp and then delignifying bleaching the activated pulp, which comprises treating chemical cellulose pulp in an activating stage with nitrogen oxides in the form of $NO_2$ and/or NO and/or polymer forms and double-molecules thereof, such as $N_2O_4$ and $N_2O_3$ and with an oxygen-containing gas in the presence of nitric acid added in an amount within the range from about 0.1 to about 1.0, suitably from 0.15 to 0.80, and preferably from 0.25 to 0.60, g mole per kg of water accompanying the cellulose pulp at a temperature within the range from about 40° to about 120° C., suitably from 50° to 100° C., preferably from 55° to 90° C. for an activating time at an activating temperature of from 40° to 50° C. of from about 15 to about 180 minutes, at a temperature of from 50° to 90° C. of from about 5 to about 120 minutes, and at temperatures above 90° C. from 1 to about 10 minutes, followed by a washing and at least one delignifying stage in an aqueous alkaline medium, either in the presence or in the absence of oxygen gas and/or peroxide.

The combination of these nitrogen oxides and nitric acid provides an activating effect which results in a greatly improved delignification after the alkaline delignifying stage. The delignifying effect obtained in accordance with the invention with 2% $NO_2$ by weight of the dry pulp is approximately the same as that obtained with twice the amount of $NO_2$, if no nitric acid is added. This is surprising, since treatment of the pulp with nitric acid in a concentration within the stated range prior to the alkaline stage, without any addition of $NO_2$ and/or NO, has no appreciable effect on the delignification. The activating effect is obtained irrespective of whether or not oxygen or peroxide is present in the alkaline delignifying stage.

It is surprising that when a suitable amount of nitric acid is present during the activating stage, depolymerization of the carbohydrates, primarily in cellulose, is slowed down in the alkaline delignifying stage when the alkaline medium constitutes an oxygen gas delignifying medium. Thus, under optimum conditions while there is a certain depolymerization (loss in viscosity) in the activating stage, a pulp is nonetheless obtained whose viscosity after the alkaline oxygen gas delignifying stage, not only when compared at the same lignin content (Kappa number) of the pulp but also when compared at the same reaction time in the oxygen gas stage, is markedly higher than that of pulp similarly activated, but without nitric acid being added during the activating stage. Obviously, when an optimum amount of nitric acid is present, the activation provides a chemical reaction which greatly inhibits the degradation of cellulose in the subsequent alkaline oxygen gas bleaching stage.

Two-stage methods comprising pretreatment of pulp with nitrogen dioxide followed by oxygen gas bleaching with sodium hydroxide as the active alkali enable extensive delignification to be carried out, but chemical consumption, however, is high, and it is difficult to obtain simultaneously extensive delignification, paper of good strength properties from the pulp, and a high carbohydrate yield, without incurring high costs.

Rising energy prices have made necessary the replacing of present energy-consuming and environmentally-harmful chemical-pulp bleaching processes with a process which consumes less energy and which, in addition, enables all, or at least a major part, of the waste liquors deriving from the bleaching plant to be burned in conventional waste-liquor combustion processes. The oxygen gas bleaching of pulp directly after digestion, using sodium hydroxide as the active alkali, is a process now used in many sulphate plants. The process affords a reduction in the amount of chlorine and sodium hydroxide used in the bleaching stages, and enables release and combustion of about half of the total amount of dry solids released in the bleaching stages. When the oxygen gas bleaching process is more extensive, the carbohydrates are excessively depolymerized, resulting in a pulp having poorer paper qualities. An important recognized problem is how to effect more extensive delignification using smaller amounts of chlorine, sodium hydroxide and oxygen gas, while burning a larger percentage of the waste by products.

In accordance with the present invention, a process is provided for delignifying bleaching lignin-containing cellulose pulp in three stages, an activating stage, in which there is supplied to the water-containing pulp NO and/or $NO_2$ and $O_2$, and optionally $HNO_3$; a first alkaline stage, in which alkali is supplied as carbonate, primarily $HCO_3^-$, with oxygen gas; and a second alkaline stage in which alkali is supplied as carbonate, primarily $CO_3^{--}$, with oxygen gas.

The process according to the invention comprises:

(1) activating cellulose pulp by reacting the pulp with a gas comprising $NO_2$ and oxygen and optionally nitric acid in the presence of water;

(2) washing the activated pulp with water or an aqueous solution;

(3) treating the activated washed pulp with an aqueous alkaline solution comprising an alkaline carbonate of which a major proportion is in the form of bicarbonate $HCO_3^-$ at a temperature within the range from about 90° to about 170° C., suitably from about 105° to about 160° C., preferably from about 115° to about 140° C., in the presence of oxygen gas at an average oxygen partial pressure within the range from 0.001 to about 0.2 MPa, until the lignin content of the pulp is so reduced that the Kappa number of the pulp is within the range from about 10 to about 60%, suitably within the range from about 20 to about 50%, preferably within the range from about 25 to about 40% of the Kappa number of the pulp entering the activating stage (1), and releasing carbon dioxide gas liberated;

(4) treating the activated washed pulp with an aqueous alkaline solution comprising an alkaline carbonate of which a major proportion is in the form of carbonate $CO_3^{--}$ at a temperature within the range from about 90° to about 170° C., suitably within the range from about 110° to about 150° C., preferably within the range from about 120° to about 140° C., in the presence of oxygen gas at an average oxygen partial pressure within the range from about 0.1 to about 3 MPa, suitably within the range from about 0.2 to about 1.8 MPa, preferably within the range from about 0.3 to about 1.0 MPa;

(5) withdrawing from stage (4) alkaline liquor comprising $HCO_3^-$ and recycling said liquor to stage (3) as a source of $HCO_3^-$.

The process of the invention is applicable to any chemical cellulose pulp, but especially chemical cellulose pulp prepared using an alkaline pulping liquor. Examples of alkaline chemical pulps include sulfate pulp, polysulfide pulp and soda pulp. In the soda pulp group are included pulps digested with sodium hydroxide as well as other alkaline materials, in the presence of the usual additives. Examples of additives include redox catalysts, such as anthraquinone. The process is also applicable to other chemical pulps, such as, for example, sulfite pulp.

The alkaline treatment stages (3) and (4) are refferred to herein as E1 and E2, respectively.

The alkaline stages F1 and F2 can be carried out at a pulp consistency within the range from about 2 to about 50%, suitably within the range from about 6 to about 40%, preferably within the range from about 8 to about 35%. It is an advantage to have different consistencies in stages E1 and E2, and in different zones in each of these stages.

When oxygen-containing gas is not intentionally charged to stage E1, or only a small amount of oxygen-containing gas is charged thereto, known apparatus for the hot-alkalization of cellulose pulp can be used in this stage. When oxygen-containing gas is charged to stage E1, the apparatus used may be of the kind previously proposed for oxygen gas-alkali-delignification (oxygen gas bleaching). These apparatus can also be used for stage E2.

The apparatus used in stage E1 is provided with means for withdrawing carbon dioxide gas either continuously or intermittently. The heat possessed by the discharged gaseous mixture of carbon dioxide, water vapor and residual gas is used for heating purposes, preferably within the bleaching system.

The source of carbonate for stages E1 and E2 is normally primarily sodium carbonate ($Na_2CO_3$). If available, a minor quantity of sodium bicarbonate $NaHCO_3$ can also be supplied for improved process control, and to re-start the process after a shut-down. Magnesium carbonate, for example in the form of $MgCO_3$, can also be added, and serves as a source of magnesium as well. The term "carbonate" as used herein generally includes both hydrogen carbonate $HCO_3^-$ and carbonate $CO_3^{--}$, and carbonates incorporated in complex compounds; $HCO_3^-$ bicarbonate only and $CO_3^{--}$ carbonate only are indicated only when specifically referred to.

Careful analysis of the solution for alkali and carbonate can sometimes be difficult. The process can be controlled to advantage, however, by determining titratable alkali in alkaline solutions and waste liquors. Titratable alkali can be quickly determined by titration with standard acid, for example hydrochloric acid, to pH 7 while boiling off carbon dioxide, so that the carbonate is decomposed without substantial quantities of the carboxylic acids being driven off or affected, for example, lactonized.

When a pulp of high consistency is used, for example a consistency higher than 20%, it is simpler to mix the alkaline solution in the pulp before the pulp is treated in stage E1 or stage E2. This method can also be applied with pulps of low or average consistency, although in this case an advantage is afforded by mixing the alkaline solutions with the pulp successively in the reactor vessel itself, or in a mixing apparatus associated with the actual stages. Addition in several increments at spaced intervals reduces variations in pH during the process.

In addition to bicarbonate $HCO_3^-$, *the solution supplied to stage E1 also includes a minor molar proportion of carbonate* $CO_3^{--}$, i.e., the amount of carbonate ($CO_3^{--}$), calculated in moles, is smaller than the amount of bicarbonate $HCO_3^-$ charged. Usually the molar concentration ratio $CO_3^{--}/HCO_3^-$ is less than 0.2, preferably less than 0.1. During stage E1, the concentration of $CO_3^{--}$ decreases, and is practically zero at the end of the stage.

Sodium carbonate in solid form can be supplied to the pulp in stage E2 or before reaching stage E2. Sodium carbonate in solid form, recovered, for example, from a smelt derived from a sulphate plant or a sodium-based sulphite plant in a known manner, is a suitable alkali for use in the method according to the invention. Recovery may also be effected so as to obtain a recovered aqueous solution of sodium carbonate, as for example, in the so-called Tampella process. Normally, a certain amount of spent alkaline liquor from stage E2 is recycled to this stage, either directly or, preferably, via a washing stage, or a dilution stage incorporated between stages E1 and E2 and combined with pressing and washing processes. Sodium carbonate is suitably dissolved in spent liquor obtained from this intermediate stage, or in spent liquor directly recovered from stage E2. In this way, waste liquor from E1 is separated between stages E1 and E2, by pulp pressing or washing processes, or by a combined pulp pressing and washing process. The washing liquor or diluting liquor used is primarily spent liquor from E2. Thus, some carbonate $CO_3^{--}$ and bicarbonate $HCO_3^-$ are also returned to stage E2.

In the course of stage E2, at least 50 mole %, suitably from about 60 to about 100 mole %, preferably from about 70 to about 95 mole % of carbonate newly supplied to stage E2 in the form of $CO_3^{--}$, primarily as $Na_2CO_3$, should be converted to hydrogen carbonate $HCO_3^-$. The newly supplied carbonate $CO_3^{--}$ is the total amount of divalent carbonate $CO_3^{--}$ minus the amount which is recycled as spent alkaline liquor to stage E2.

In order to keep consumption of substantially pure oxygen low, the amount of newly supplied carbonate is so adjusted that at most 0.2 mole, suitably at most 0.1 mole, preferably at most 0.05 mole, of carbon dioxide gas calculated per mole of newly supplied carbonate $CO_3^{--}$ is transferred to the gas phase in stage E2.

Oxygen-containing gas is always supplied to stage E2, but stage E1 can be carried out in the presence of oxygen without supplying oxygen-containing gas thereto. In accordance with a preferred embodiment, air or other oxygen-containing gas mixture is supplied to stage E1 at an oxygen partial pressure of 20 to 90% of the total gas pressure measured after complete gasification of these substances in the sample to be analyzed. Examples of suitable oxygen-containing gas include waste gas from stage E2, from the activating stage, or from some other manufacturing process, or air enriched with oxygen gas using a molecular sieve method.

Pure oxygen gas can be used in stage E1, and mainly affords the advantage that water vapor losses in conjunction with the removal of the carbon dioxide can be reduced by simple means, in comparison with the case where the oxygen gas is diluted with, for example, nitrogen and carbon dioxide.

Normally, substantially pure oxygen gas is supplied to stage E2, this gas normally being obtained by vaporizing liquid oxygen. An oxygen-containing gas mixture can also be used.

During the alkaline treatment of the pulp with oxygen-containing gas in stage E2, and where applicable in stage E1, the partial pressure of oxygen gas is held practically constant in respective stages. This can be effected, for example, by supplying gas to the system and by circulating the gas present in the reactor vessel. A marked simplification and improvement of the economy is obtained, however, when the partial pressure is varied within the oxygen gas stages.

The average oxygen partial pressure is the arithmetic average value of the highest and the lowest oxygen partial pressures in the presence of the pulp during the stage in question. The treatment time is calculated from the moment the pulp is brought into contact with the oxygen-containing gas. The oxygen gas stage not only includes the reactor vessel in which the pulp is normally located during the major part of the treatment, but also includes such apparatus as pumps, disintegrators and emulsion apparatus for thoroughly mixing the substances together, and for dissolving oxygen in the aqueous pulp mixture. The apparatus may be of the kind described and conventionally used in oxygen gas bleaching processes, preferably at low and medium pulp consistency, with sodium hydroxide as the active alkali.

In stage E1, it is suitable to work with a steep pressure gradient with respect to the oxygen partial pressure. In accordance with a preferred embodiment, in order to minimize the loss of vapor when withdrawing liberated carbon dioxide, the oxygen partial pressure is maintained at a low level, for example at from about 0.002 to about 0.02 MPa, in the zone where the carbon dioxide is withdrawn. Advantageously, this zone is placed in the proximity of the pulp inlet end of the reactor.

The process makes it possible to carry out stage E1 at high pulp consistencies, for example, consistencies of from about 25 to about 40%, in a tower through which the pulp moves downwardly by gravity. Thus, the pulp is discharged from the bottom of the tower. The major part of the oxygen-containing gas is introduced at the lower half of the reactor, and carbon dioxide is taken out close to the top of said vessel, and optionally also at other zones of the reactor.

Noticeable advantages with regard to heat economy and also with respect to the desire to minimize depolymerization of the carbohydrates are obtained when stage E1 is divided into two or more zones, including a gas phase with increasing oxygen partial pressure for each zone. For the sake of simplicity, no liquid is normally removed from the pulp during passage through the zones or therebetween. When a pulp of low or average consistency is used, additives, for example, active alkali, can be introduced during or between the zones in a simple manner. The advantages, however, are often great even when the liquid phase is retained during all zones.

A particular advantage is afforded when the pulp is subjected in a first zone to a hot-alkali treatment without intentionally supplying oxygen-containing gas and the pulp is then treated in one and/or several subsequent zones with oxygen gas.

It has been found that while the lignin is activated in the activating stage, so as to be attacked and removed more rapidly in the alkaline stages, the carbohydrates are somehow passivated by the $NO_2/O_2$-treatment against degradation in stage E1 when oxygen is present, and likewise in stage E2. The reason why this effect is obtained is not clearly understood. It has been found, however, that the effect depends only to a slight extent on the dissolution of metal compounds which takes place in conjunction with the activating stage, and with the treatment of pulp with acid waste liquor from the stage.

in the activating stage, nitrogen dioxide is supplied solely as substantially pure $NO_2$, or is allowed to form in the reactor vessel subsequent to supplying nitric oxide and oxygen thereto. $NO_2$ together with NO can also be supplied. Dinitrogen tetroxide ($N_2O_4$) and other polymer forms are included in the term "nitrogen dioxide ($NO_2$)". One molecule of dinitrogen tetroxide is considered to be equal to two molecules of nitrogen dioxide. Adducts in which nitric oxide is present are considered as nitric oxide. Thus, dinitrogen trioxide ($N_2O_3$) is considered as one molecule of nitric oxide and one molecule of nitrogen dioxide. Adducts with oxygen probably occur as intermediates.

A certain amount of oxygen gas must be supplied to the activating stage, both when nitrogen dioxide ($NO_2$)

is charged and when nitric oxide (NO) is charged. The oxygen-containing gas may be air.

In order to obtain the best possible result with the simplest apparatus possible, it is, however, suitable to supply the oxygen to the activating stage in the form of substantially pure oxygen gas. Liquid oxygen can also be supplied to the activating stage and vaporized, for example when entering the reactor in which the activating process is carried out. The use of substantially pure oxygen results in a lower content of $NO+NO_2$ in the gas phase than when air is used. This also means that only a minor quantity of inert gas need be removed from the reactor and optionally treated to render residual gases harmless.

The amount of oxygen charged to the activating stage is adapted to the amount of nitrogen oxides charged, so that the charge of oxygen per charged mole of $NO_2$ is at least 0.08 mole, suitably within the range from about 0.1 to about 2.0 mole $O_2$, preferably from about 0.15 to about 0.30 mole $O_2$.

If NO or a mixture of NO and $NO_2$ is used, the oxygen gas charge is so made that the amount of oxygen charged is at least 0.60 mole, suitably with the range from about 0.65 to about 3.0, preferably from about 0.70 to about 0.85 mole $O_2$ per mole of NO charged. When NO is used, the charge is preferably made in increments or continuously in a manner such that oxygen is supplied in increments or continuously before the supply of NO is terminated. In this way, activation is more uniform than when oxygen gas is not supplied until all NO has been charged to the reactor. The reactor can be designed for batchwise operation, or for continuous operation with continuous pulp flow and supply of gases in, through and out.

The activation temperature should normally be within the range from about 30° to about 120° C., suitably within the range from about 40° to about 100° C., preferably within the range from about 50° to about 90° C.

The reaction time at an activating temperature of 30° to 50° C. is suitably within the range from about 15 to about 180 minutes, and at 50° to 90° C. within the range from about 5 to about 120 minutes, and at higher temperatures within the range from about 1 to about 10 minutes. The pulp consistency is within the range from about 15 to about 50%, suitably within the range from about 20 to about 45%, preferably within the range from about 27 to about 40%.

The amount of nitrogen oxides is adapted in accordance with the lignin content, the desired degree of delignification, and the extent to which attack on the carbohydrates can be tolerated. Calculated as monomers, the amount is normally within the range from about 0.1 to about 4, suitably within the range from about 0.3 to about 2.5, preferably within the range from about 0.5 to about 1.5 kilomoles per 100 kg lignin in the pulp entering the activating stage.

It has been found that the combination of the aforementioned nitrogen oxides and impregnation of the pulp with nitric acid of suitable concentration provides an activating effect which is reflected in a greatly improved delignification after the alkaline stages. Thus, the effect obtained after impregnating with nitric acid containing 0.4 g mole $HNO_3$ per kg water together with 2% $NO_2$, calculated on the dry weight of the pulp, is approximately the same as that obtained with twice the amount of $NO_2$ if no nitric acid is added or is returned to the activating stage. This is surprising, since treatment of the pulp with nitric acid having a concentration within the range in question prior to the alkaline stage, without any addition of $NO_2$ and/or NO, has no appreciable effect on the delignification. The concentration of nitric acid in the cellulose pulp prior to introducing the oxides of nitrogen is, for example within the range from about 0.1 to about 1, suitably within the range from about 0.15 to about 0.80, preferably within the range from about 0.25 to about 0.60 gram molecule per kg of water accompanying the cellulose pulp.

Impregnation of the pulp with nitric acid of increasing concentration, and an increase in the charge of nitrogen oxides, increased pulp consistency, increased temperture and increased time in the activating stage, contribute both to increased activation, i.e., lower lignin content after the alkaline stages, and to increased depolymerization of the carbohydrates during the actual activating stage, and to an increase in the loss of carbohydrates during this stage. It is thus obvious that all five of these parameters should be adapted to one another, so as to obtain an optimum result with regard to the quality of the treated pulp, pulp yield, and the cost of the process, and also to the extent to which the environment is affected. Selection of the parameters is also made more difficult by the passivation of the carbohydrates as a result of the activating process for the lignin. In addition, the effects are totally different with different types of pulps, for example sulphite pulps and sulphate pulps. Also, the type of wood used plays a part. Hardwood pulps are affected more by the high values of said parameters than softwood pulps.

On the basis of tests carried out, it has been established that it is not possible to obtain good activation when carrying out the method according to the invention unless the intrinsic viscosity of the pulp is lowered to a certain extent during the activating stage. This lowering of the intrinsic viscosity should be at least 2% and at most 35%, suitably within the range from about 4 to about 20, preferably within the range from about 5 to about 12%, compared with the intrinsic viscosity of the pulp entering the activating stage. The reduction in intrinsic viscosity is strongly affected by all five of the aforementioned parameters, and surprisingly enough one reliable method which can be applied in order to optimize the process is to determine the reduction in the viscosity during the activating stage.

When carrying out the method according to the invention, depolymerization of the carbohydrates can be reduced by adding magnesium compounds, so that such compounds are present during the alkaline stages, particularly stage E2. A significant effect in stage E1 is obtained with many pulps, despite the fact that the pH in this stage is so low that no sparingly soluble magnesium compounds precipitate. It is generally believed that the primary effect afforded by magnesium compounds charged to an oxygen gas bleaching process is that magnesium hydroxide precipitates and occludes harmful trace-metal compounds.

Examples of magnesium compounds which may be charged to the process include soluble salts, for example sulphate, complex salts, for example with hydroxy acids present in the waste liquor, carbonate, oxide and hydroxide. See, for example, U.S. Pat. Nos. 3,652,385, patented Mar. 28, 1972, 3,652,386, patented Mar. 28, 1972, 3,764,464, patented Oct. 9, 1973.

Manganese salts can also be used as protector. Suitable salts in this respect are divalent manganese, for example $MnSO_4$, although trivalent and tetravalent compounds in complex form can also be used. When manganese salts are added, the pH of stage E2 should be kept as low as possible without the development of carbon dioxide in the stage becoming troublesome. See, for example, U.S. Pat. Nos. 4,050,981, patented Sept. 27, 1977, and 4,087,318, patented May 2, 1978.

The process of the invention makes possible an exceptionally extensive delignification without using chlorine and bleaching agents containing chlorine, so that the spent alkaline liquors can be combusted together with cooking waste liquor in conventional soda recovery boilers. When compared with a method in which the cellulose pulp, similar to the method according to the present invention, is activated with $NO_2$ and $O_2$, but in which the subsequent alkaline delignification process is carried out with the use of sodium hydroxide, the method according to the invention affords the advantages of lower chemical costs and lower energy consumption, and also an increase in pulp yield. In addition, in the case of many types of pulp there is obtained a decrease in the depolymerization of the carbohydrates.

A preferred embodiment of the method according to the invention, for application on a plant scale, is shown in the flow diagram of FIG. 1.

Pulp is passed from the digester via line 1*a* into washing apparatus 1 having sequential zones 2, 3, 4 and 5, which gradually merge one with the other. Alternatively, the washing zones may be placed in separate washers. When digestion is effected in a continuous digester, the washing zones can advantageously be incorporated in the digester.

The unbleached pulp advances through said washing zones, and is transferred from the last washing zone through line 6 to a liquor separator 7, where liquor is removed from the pulp, for example, by pressing the pulp, so that the pulp has a higher consistency than the consistency of the pulp leaving the digester. Acid waste liquor recovered from the liquor separator 7 is passed through line 8, and is used for washing the pulp in zone 5 adjacent the outlet end of the washer. From the liquor separator 7 the pulp is passed through line 9 to an activating reactor 10, were the pulp is activated at a total pressure which, for example, is from 1 to 30% below ambient atmospheric pressure. NO and/or $NO_2$ is supplied through line 11 connected to the activating reactor 10 adjacent its pulp inlet. $O_2$ is supplied through line 12 connected to the activating reactor adjacent its pulp outlet. As the pulp moves down through the activating reactor 10, the temperature increases slightly in the direction of movement of the pulp. By introducing relatively cold oxygen gas, the temperature of the pulp (and surrounding gas) is lowered at the outlet of the activating reactor 10.

The supply of oxygen gas is regulated by continuously analysing the gas phase, and registering the pressure. The supply of oxygen gas through line 12 is so adjusted that the amount of nitric oxide and/or nitrogen dioxide present at the reactor outlet reaches preferred values, both from the aspect of activation and the aspect of environmental care.

The pulp passes from the activating reactor 10 via a line 13 to a washing apparatus 14, where the pulp is washed and/or pressed. The washing apparatus 14 may, for example, comprise one or more washing presses. The washing is divided into zones, in the illustrated embodiment, three washing zones 15, 16 and 17. The number of washing zones can be reduced to two, in which case washing with water can be excluded, or can be increased to four or more zones, in which case the washing is by counterflow.

Water or an acid aqueous solution is supplied to the washing zone 15 through line 18, to displace acid waste liquor from the activating stage. Liquid recovered from the washing zone 15 is passed through line 19 to the third washing zone 4 in the washing apparatus 1. After passing washing zones 16 and 17, the pulp is passed through line 20 to the first alkaline stage (=E1) which is carried out in reactor 21. Air and/or waste gas from the second alkaline stage (=E2) downstream is introduced to the reactor 21 through line 22. Heat is supplied to the pulp so that the temperature, for example, is higher than 100° C. Carbon dioxide escapes from the reactor through pipe 23.

The pulp then passes through line 24 to a liquor separator 25, which may be, for example, a press or a filter. When washing and/or dilution are included, waste liquor from the second alkaline stage (=E2) is passed to the liquor separator 25 through lines 26 and 27. Alkaline waste liquor removed from the liquor separator 25 and having a low $HCO_3^-$ content is conveyed through line 28 to zone 16 in the washing apparatus 14. Liquor taken from zone 16 is passed through line 29 to the second zone 3 of the washing apparatus 1.

The pulp passes from the liquor separator 25 through line 30 to the second alkaline stage (=E2) in reactor 31. Suitably, the line 30 comprises a mixer, in which alkali and pulp are mixed. Alkali, i.e. $CO_3^{--}$, for example in the form of concentrated aqueous solution, is supplied through line 32. If necessary, heat is supplied to the pulp so that the temperature exceeds, for example 100° C.

Oxygen gas is supplied to the reactor 31 through line 33, in sufficient amount to provide an oxygen superatmospheric pressure. To avoid concentrating inert gas (which enters primarily together with the pulp) and carbon dioxide in the gas phase in reactor 31, a small part of the gas phase is withdrawn (not shown in the Figure) and introduced into the reactor 21 through line 22.

Pulp is conveyed from the reactor 31 through line 34 to the liquor separator 35, where spent liquor from the second alkaline stage (=E2) is saparated by pressing and/or washing the pulp. This can be effected, for example, in one or more washing presses. The pulp leaves the system through line 36, for continued bleaching and/or for use in, for example, a paper making plant and/or to be worked-up into market pulp. Waste liquor separated from the pulp in the liquor separating means 35 is withdrawn through line 26, and conveyed to zone 17 in the washing apparatus 14. The waste liquor recovered from zone 17 is passed through line 37 to zone 2 of the washing apparatus 1, and is used there to displace cooking waste liquor. A part of the flow from line 26 can be withdrawn, passed through line 38, and mixed with the pulp in line 20. It is possible to return waste liquor from the second alkali stage (=E2) directly to the same stage by using the lines 26 and 39.

For the sake of simplicity, in the illustrated flow diagram lines required for diluting and rinsing the pulp downstream of the reactors have not been shown. Neither have the devices required for introducing liquor for washing and liquor-separating purposes been shown. The process parameters for the activating stage and the two alkaline stages can be selected from the general parameters of the method according to the invention.

The following Examples represent further preferred embodiments of the invention. These are laboratory tests in which an industrial process has been simulated. For practical reasons, the tests have been carried out batchwise, while the method illustrated in FIG. 1 represents a continuous method of treatment of the pulp. The alkaline stages have been carried out with a pulp at medium consistency, which was found to be the most suitable with the laboratory apparatus available.

EXAMPLE 1

An unbleached sulphate pulp from softwood, mainly pine, having a Kappa number of 32.6 and an intrinsic viscosity of 1226 $dm^3/kg$, was washed with waste liquor recovered by treating with water and pressing pulp derived from earlier $NO_2/O_2$-pretreatment processes of the same unbleached pulp. Washing was carried out in countercurrent flow. The newly supplied pulp was in this way impregnated with waste liquor containing nitric acid formed in earlier $NO_2/O_2$-pretreatment processes. Subsequent to being impregnated in this manner, the newly supplied pulp was pressed to a solids content of 30%. The concentration of the nitric acid retained by the pulp was adjusted to 0.38 mole $HNO_3$ per kilogram of water in the pulp.

The pulp was treated batchwise in a rotating activating reactor, which prior to introducing $NO_2$ thereto had been evacuated and then heated to 45° C. 2% $NO_2$, calculated on the dry weight of the pulp, was supplied to the reactor over a period of 5 minutes. Oxygen gas was then introduced into the reactor over a period of 3 minutes, so as to reach atmospheric pressure. The temperature rose to 50° C. during the treatment, and this temperature was maintained for a reaction time totalling 60 minutes, calculated from the time at which the supply of $NO_2$ to the reactor was commenced. The pulp was then washed in countercurrent flow, first with earlier waste liquor from the activating stage, then pressed, and lastly washed with water. Waste liquor containing nitric acid was recovered in this way, this waste liquor being used to impregnate untreated pulp.

Subsequent to the activating stage, the intrinsic viscosity of the pulp was 1130 $dm^3/kg$. The Kappa number was 29.7.

The activated, water-washed pulp was treated batchwise with waste liquor having a pH of about 8, obtained from the first alkaline stage (E1). Accompanying water was displaced in this way. The pulp was pressed and then impregnated with waste liquor from the second alkaline stage (E2), to which magnesium sulphate had been added. The impregnation was effected so as to impart to the pulp a consistency of 12%, and so that the pulp suspension contained magnesium compounds corresponding to 0.3% magnesium calculated on the dry weight of the pulp, and an amount of titratable alkali corresponding to 1.0 gram molecule per 1000 g bone dry untreated pulp.

The impregnated pulp was introduced into an autoclave provided with pipes and valves for pressure control relief and the introduction of gas, respectively. The autoclave was thermostat-controlled, and was rotated so as to obtain thorough contact between the gas phase and pulp suspension. The pulp was treated for half an hour at 130° C. in the absence of oxygen gas during a first part of the E1 stage. Removal of carbon dioxide and water vapor was effected when half the treatment time had elapsed, and at the end of this treatment. Air under pressure was then supplied to the autoclave, so as to obtain an initial pressure with respect to oxygen gas of 0.06 and a final pressure of 0.02 MPa, measured at the treatment temperature, which was also 130° C. in this part stage. The treatment time was half an hour in this second part of the E1 stage.

Carbon dioxide and water vapor were driven off when half the treatment time had elapsed, and at the end of the treatment. After stage E1, the Kappa number had fallen to 12.5, and the viscosity to 1110 $dm^3/kg$.

Waste liquor from stage E1 was filtered off and pressed out, so as to obtain a pulp consistency of 36%. For the sake of simplicity, all the liquor pressed from the pulp was used to displace water in the aforedescribed manner. (In a plant process, and in particular in a continuous process, part of the liquor recovered from the E1 stage can be suitably returned to the E1 stage, primarily to increase the solids content of this waste liquor. A schedule in which many liquors are recycled is difficult to carry out, however, on a laboratory scale. When recycling to all stages, it is either difficult to determine the pulp yield, or the results obtained are unreliable. Similarly, the accuracy of determining yield in laboratory tests is jeopardized by sampling the pulp for analysis before the whole process has been completed.)

The pressed pulp was treated with a solution containing sodium carbonate ($Na_2CO_3$) obtained by the dissolution in waste liquor from stage E2 of crystallized sodium carbonate produced by chilling green liquor from a sulphate pulp plant. The consistency of the pulp was lowered to 12% after mixing this solution with the pulp. The amount of sodium carbonate added was 0.6 gram molecule per 1000 g bone dry, untreated pulp, which corresponds to 1.2 gram molecules of titratable alkali.

The pulp was returned to the autoclave, and treated with oxygen gas (E2) at a temperature of 130° C. for one hour at a mean oxygen partial pressure of 0.6 MPa. Waste liquor was recovered from this stage by pressing and washing the pulp, and used in the aforedescribed manner. The resultant pulp had a Kappa number of 7.0 and an intrinsic viscosity of 970 $dm^3/kg$. The pulp yield, calculated on the dry weight of the original pulp, was 94.5%.

The Example illustrates that a pulp having an exceptionally low Kappa number can be produced by the method according to the invention with modest degradation of the cellulose. The pulp yield is higher than the yield achieved with the same activating process when using sodium hydroxide in subsequent alkaline treatment processes. The method enables the use of alkali recovered by integrated combustion of cooking waste liquor (black liquor) and waste liquor from the method according to the invention. The method is energy-saving, and no apparatus are required for absorbing carbon dioxide from used oxygen gas. Less oxygen gas is required than in any other processes, which results in a high cellulose yield at low Kappa number.

EXAMPLE 2

An unbleached sulphate pulp from softwood, mainly spruce, having a Kappa number of 30.3 and an intrinsic viscosity of 1248 $dm^3/kg$, was washed with waste liquor recovered by treating with water and pressing pulp derived from earlier $NO_2/O_2$-pretreatment processes of the same unbleached pulp. Washing was carried out in countercurrent flow. The newly supplied pulp was in this way impregnated with waste liquor containing nitric acid formed in earlier $NO_2/O_2$-pretreatment processes. Subsequent to being impregnated in this manner, the newly supplied pulp was pressed to a solids content of 30%. The concentration of the nitric acid retained by the pulp was adjusted to 0.38 mole $HNO_3$ per kilogram of water in the pulp.

The pulp was treated batchwise at a pulp consistency of 35% in a rotating activating reactor, which prior to introducing $NO_2$ thereto had been evacuated and then heated to 42° C. 2% $NO_2$, calculated on the dry weight of the pulp, was supplied to the reactor over a period of 5 minutes. Oxygen gas was then introduced into the reactor over a period of 3 minutes, so as to reach atmospheric pressure. The temperature rose to 47° C. during the treatment, and this temperature was maintained for a reaction time totalling 60 minutes, calculated from the time at which the supply of $NO_2$ to the reactor was commenced. The pulp was then washed in countercurrent flow, first with earlier waste liquor from the activating stage, then pressed, and lastly washed with water. Waste liquor containing nitric acid was recovered in this way, this waste liquor being used to impregnate untreated pulp.

Subsequent to the activating stage, the intrinsic viscosity of the pulp was 1140 $dm^3/kg$. The Kappa number was 28.0.

The activated, water-washed pulp was treated batchwise with waste liquor having a pH of about 8, obtained from the first alkaline stage (E1). Accompanying water was displaced in this way. The pulp was pressed and then impregnated with waste liquor from the second alkaline stage (E2), to which magnesium sulphate had been added. The impregnation was effected so as to impart to the pulp a consistency of 18%, and so that the pulp suspension contained magnesium compounds corresponding to 0.3%, magnesium calculated on the dry weight of the pulp, and an amount of titratable alkali corresponding to 1.0 gram molecule per 1000 g bone dry untreated pulp.

The impregnated pulp was introduced into an autoclave provided with pipes and valves for pressure control relief and the introduction of gas, respectively. The autoclave was thermostate-controlled, and was rotated so as to obtain thorough contact between the gas phase and pulp suspension. The pulp was treated at 135° C. in the absence of oxygen gas. Removal of carbon dioxide and water vapor was effected after 15, 30, 45 and 60 minutes treatment time had elapsed. After stage E1, the Kappa number had fallen to 13.3, and the viscosity to 1150 $dm^3/kg$.

Waste liquor from stage E1 was filtered off and pressed out, so as to obtain a pulp consistency of 36%. For the sake of simplicity, all the liquor pressed from the pulp was used to displace water in the aforedescribed manner. (In a technical process, and in particular in a continuous process, part of the liquor recovered from the E1 stage can be suitably returned to the E1 stage, primarily to increase the solids content of this waste liquor. A schedule in which many liquors are recycled is difficult to carry out, however, on a laboratory scale. When recycling to all stages, it is either difficult to determine the pulp yield, or the results obtained are unreliable. Similarly, the accuracy of determining yield in laboratory tests is jeopardized by sampling the pulp for analysis before the whole process has been completed.)

The pressed pulp was treated with a solution containing sodium carbonate ($Na_2CO_3$) obtained by the dissolution in waste liquor from stage E2 of crystallized sodium carbonate produced by chilling green liquor from a sulphate pulp plant. The consistency of the pulp was lowered to 12% after mixing this solution with the pulp. The amount of sodium carbonate added was 0.6 gram molecule per 1000 g bone dry, untreated pulp, which corresponds to 1.2 gram molecules of titratable alkali.

The pulp was returned to the autoclave, and treated with oxygen gas (E2) at a temperature of 130° C. for one hour at a mean oxygen partial pressure of 0.6 MPa. Waste liquor was recovered from this stage by pressing and washing the pulp, and used in the aforedescribed manner. The resultant pulp had a Kappa number of 6.5 and an intrinsic viscosity of 960 $dm^3/kg$. The pulp yield, calculated on the dry weight of the original pulp, was 93.8%.

This Example shows that oxygen-containing gas need only be supplied to stage E2. The absence of oxygen gas in stage E1 tends to slightly lower the pulp yield. The decrease is small, however. The advantage afforded by Example 2 over Example 1 is that the apparatus is simplified, and that the use of the heat content of the expelled carbon dioxide is facilitated.

Having regard to the foregoing disclosure the following is claimed as the inventive and patentable embodiments thereof:

1. A process for delignifying bleaching lignin-containing cellulose pulp which comprises:

(1) activating cellulose pulp by reacting the pulp with a gas comprising $NO_2$ and oxygen in the presence of water at a temperature within the range from about 30° to about 120° C. while so controlling the amount of nitrogen oxides, the pulp consistency, the temperature, and the residence time so that the reduction in intrinsic viscosity of the pulp at the end of this stage is limited to within the range from 2 to 35% less than at the beginning of the stage;

(2) washing the activated pulp with water or an aqueous solution;

(3) treating the activated washed pulp with an aqueous alkaline solution comprising an alkaline carbonate of which a major proportion is in the form of $HCO_3^-$ at a temperature within the range from about 90° to about 170° C., in the presence of oxygen gas at an average oxygen partial pressure within the range from 0.001 to about 0.2 MPa, until the lignin content of the pulp is so reduced that the Kappa number of the pulp is within the range from about 10 to about 60% of the Kappa number of the pulp entering the activating stage (1), and releasing carbon dioxide gas liberated;

(4) treating the activated washed pulp from step (3) with an aqueous alkaline solution comprising an alkaline carbonate of which a major proportion is in the form of $CO_3^{--}$ at a temperature within the range from about 90° to about 170° C., in the presence of oxygen gas at an average oxygen partial pressure within the range from about 0.1 to about 3 MPa;

(5) withdrawing from stage (4) alkaline liquor comprising $HCO_3^-$ and recycling said liquor to stage (3) as a source of $HCO_3^-$.

2. A process according to claim 1 in which the temperature during stage (3) is within the range from about 105° to about 160° C.

3. A process according to claim 1 in which the temperature during stage (3) is within the range from about 115° to about 140° C.

4. A process according to claim 1 in which the Kappa number of the pulp in stage (3) is within the range from about 20 to about 50% of the Kappa number of the pulp entering stage (3).

5. A process according to claim 1 in which the Kappa number of the pulp in stage (3) is within the range from about 25 to about 40% of the Kappa number of the pulp entering stage (3).

6. A process according to claim 1 in which the temperature in stage (4) is within the range from about 110° to about 150° C.

7. A process according to claim 1 in which the temperature in stage (4) is within the range from about 120° to about 140° C.

8. A process according to claim 1 in which the oxygen partial pressure in stage (4) is within the range from about 0.2 to about 1.8 MPa.

9. A process according to claim 1 in which the oxygen partial pressure in stage (4) is within the range from about 0.3 to about 1.0 MPa.

10. A process according to claim 1 in which alkaline liquor withdrawn from stage (4) and recycled to stage (3) is used to wash out spent alkaline liquor from the pulp after stage (3), separated from the pulp, and then recycled to stage (3).

11. A process according to claim 1 in which the alkaline treatment of stage (4) is so controlled that at least 50 mole percent of carbonate freshly supplied to stage (4) in the form of $CO_3^{--}$ is converted to $HCO_3^-$ present in the spent alkaline liquor from stage (4).

12. A process according to claim 1 in which addition of $CO_3^{--}$ to stage (4) is so controlled that at most 0.2 kilomole of carbon dioxide gas per kilomole of added $CO_3^{--}$ is present in the gas phase in the stage.

13. A process according to claim 1 in which air or a gas mixture containing oxygen with a partial pressure within the range from 20 to 90% of the total gas pressure is supplied to stage (3).

14. A process according to claim 1 in which oxygen partial pressure is increased from the beginning to the end of stage (3).

15. A process according to claim 14 in which no oxygen-containing gas is supplied initially to stage (3).

16. A process according to claim 1 in which the amount of fresh alkaline carbonate added to stages (3) and (4) is within the range from about 4 to about 50 kilomoles per 1000 kg of lignin in the pulp introduced to stage (1).

17. A process according to claim 1 in which nitric acid is present in of the pulp prior to stage (1), the amount of nitric acid controlled that the intrinsic viscosity of the pulp at the end of stage (1) is from 2 to 35% less than at the beginning of stage (1).

18. A process according to claim 1 in which magnesium is present in an amount to reduce depolymerization of the carbohydrates during the alkaline treatment stages (3) and (4).

19. A process according to claim 1 in which manganese is present in an amount to reduce deploymerization of the carbohydrates during the alkaline treatment stages (3) and (4).

20. A process according to claim 1 in which the cellulose pulp is a chemical cellulose pulp prepared using an alkaline pulping liquor selected from the group consisting of sulfate pulp, polysulfide pulp, and soda pulp.

* * * * *